US007946931B2

(12) United States Patent
Oyama

(10) Patent No.: US 7,946,931 B2
(45) Date of Patent: May 24, 2011

(54) GOLF CLUB HEAD

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 194 days.

(21) Appl. No.: 12/007,009

(22) Filed: Jan. 4, 2008

(65) Prior Publication Data

US 2009/0036229 A1 Feb. 5, 2009

(30) Foreign Application Priority Data

Feb. 8, 2007 (JP) ..... 2007-028673

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS 5,629,475 A * 5/1997 Chastonay ..... 73/65.03
5,851,160 A * 12/1998 Rugge et al. ..... 473/349
6,478,693 B2 * 11/2002 Matsunaga et al. ..... 473/345
6,716,114 B2 * 4/2004 Nishio ..... 473/314
7,070,512 B2 * 7/2006 Nishio ..... 473/319
7,137,905 B2 11/2006 Kohno
7,147,572 B2 12/2006 Kohno et al.
2004/0176180 A1 9/2004 Yamaguchi et al.
2005/0090331 A1 * 4/2005 Oyama ..... 473/345

FOREIGN PATENT DOCUMENTS

JP 2000-126340 A 5/2000
JP 2004267438 A * 9/2004

* cited by examiner

*Primary Examiner* — Alvin A Hunter
(74) *Attorney, Agent, or Firm* — Birch, Stewart, Kolasch & Birch, LLP

(57) ABSTRACT

In a golf club head, a horizontal direction oriented from the toe side toward the heel side is defined as an X direction, while a vertical upward direction is defined as a Y direction; and the coordinate of the center of the hit face is defined as (0, 0); the coordinate of the sweet spot is defined as (x1, y1); and the coordinate of the maximum resilience point on the hit face is defined as (x2, y2). In this golf club head, x1 is +3 mm or greater and +8 mm or less, and x2 is −5 mm or greater and +2 mm or less. Preferably, the shortest distance D1 between the axis line of the shaft hole and the center of gravity G of the head is 33 mm or greater and 44 mm or less. Preferably, when the face member is divided into a toe portion and a heel portion by a plane that passes the center of the hit face along the Y direction, the area mean thickness Tt of the toe portion is smaller than the area mean thickness Th of the heel portion.

10 Claims, 6 Drawing Sheets

GOLF CLUB HEAD

This application claims priority on Patent Application No. 2007-028673 filed in JAPAN on Feb. 8, 2007. The entire contents of this Japanese Patent Application are hereby incorporated by reference.

BACKGROUND OF THE INVENTION

1. Field of the Invention

The present invention relates to a golf club head.

2. Description of the Related Art

Since golf club heads have a weight distribution, the resilience coefficient is not even at each position on the face surface. There exists a maximum resilience point on the face surface. When the impact point is close to the maximum resilience point, a great flight distance can be attained. Japanese Unexamined Patent Application Publication No. 2004-267438 discloses a golf club head which can be adapted to swing form of each golf player by devising on the position of the maximum resilience point.

With respect to the golf club heads, in addition to the flight distance, directionality of the hit ball is also important. The directionality of the hit ball is affected by the moment of inertia and the position of center of gravity of the head. Japanese Unexamined Patent Application Publication No. 2004-195005 discloses a golf club head which can improve the directionality of the hit ball by appropriately defining the depth of the center of gravity, and the moment of inertia. Japanese Unexamined Patent Application Publication No. 2004-188190 discloses a golf club head which can improve the directionality of the hit ball by appropriately defining the distance to the center of gravity and the position of the sweet spot. United States patent corresponding to Japanese Unexamined Patent Application Publication No. 2004-267438 is US2004-176180 A1. United States patent corresponding to Japanese Unexamined Patent Application Publication No. 2004-195005 is U.S. Pat. No. 7,137,905. United States patent corresponding to Japanese Unexamined Patent Application Publication No. 2004-188190 is U.S. Pat. No. 7,147,572.

SUMMARY OF THE INVENTION

The present inventor found a golf club head which can further improve the flight distance and the directionality of the hit ball based on a technical idea that is different from conventional ones. So far, location of the maximum resilience point in the vicinity of the sweet spot has been believed as an ordinary technical knowledge to persons skilled in the art. The present inventor found effectiveness achieved by reconsidering this technical knowledge.

An object of the present invention is to provide a golf club head which can improve the flight distance and the directionality of the hit ball.

In the golf club head according to the present invention, provided that: a horizontal direction oriented from the toe side toward the heel side is defined as an X direction, while a vertical upward direction is defined as a Y direction; and that the coordinate of the center of the hit face is defined as (0, 0); the coordinate of the sweet spot is defined as (x1, y1); and the coordinate of the maximum resilience point on the hit face is defined as (x2, y2), x1 is +3 mm or greater and +8 mm or less, and x2 is −5 mm or greater and +2 mm or less.

Preferably, in the aforementioned head, the shortest distance D1 between the axis line of the shaft hole and the center of gravity G of the head is 33 mm or greater and 44 mm or less.

Preferably, in aforementioned the head, when the face member is divided into a toe portion and a heel portion by a plane that passes the center of the hit face along the Y direction, the area mean thickness Tt of the toe portion is smaller than the area mean thickness Th of the heel portion.

Preferably, in the aforementioned head, the depth DG of the center of gravity is 36 mm or greater and 44 mm or less.

According to the present invention, a golf club head can be obtained which is less likely to have the face to open upon impact, and can result in a great flight distance.

DESCRIPTION OF THE PREFERRED EMBODIMENTS

Hereinafter, the present invention will be explained in detail by way of preferred embodiments with appropriate reference to the accompanying drawings.

Figure 1:
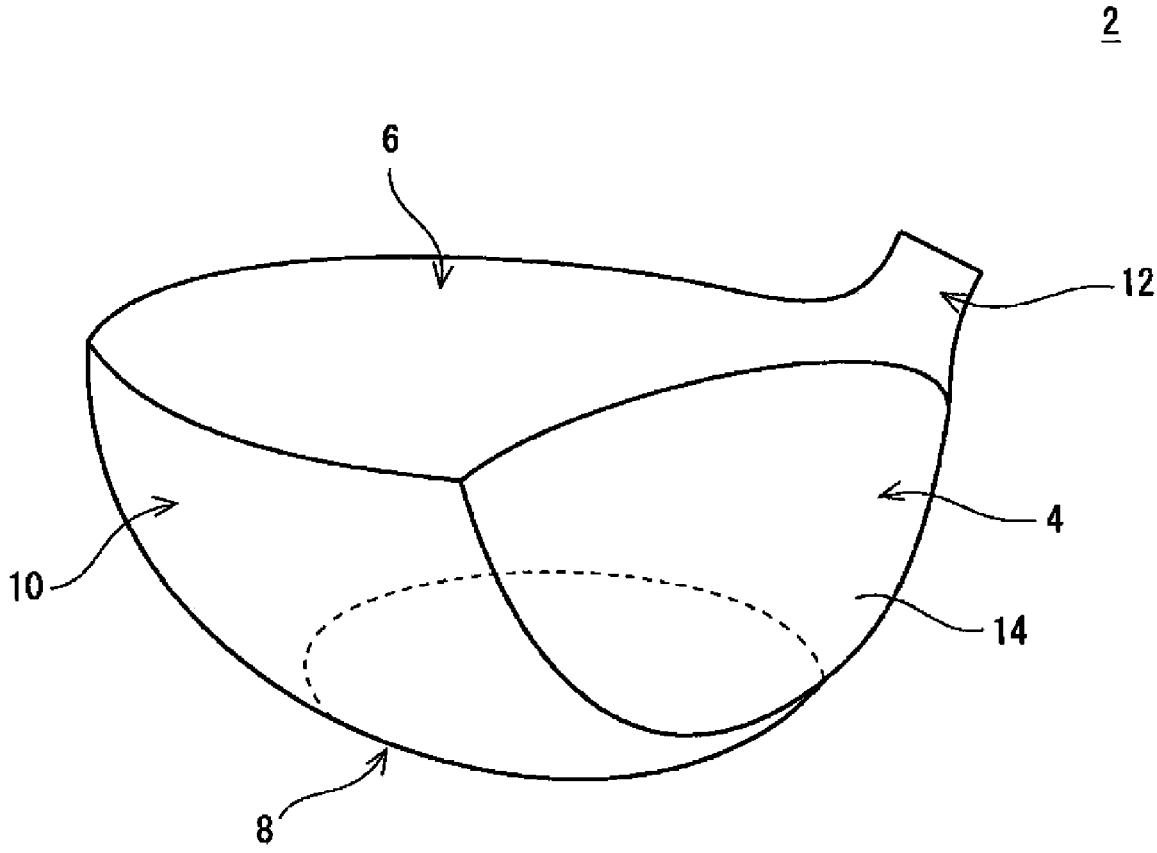
FIG. 1 shows a perspective view illustrating a golf club head according to one embodiment of the present invention.
Figure 2:
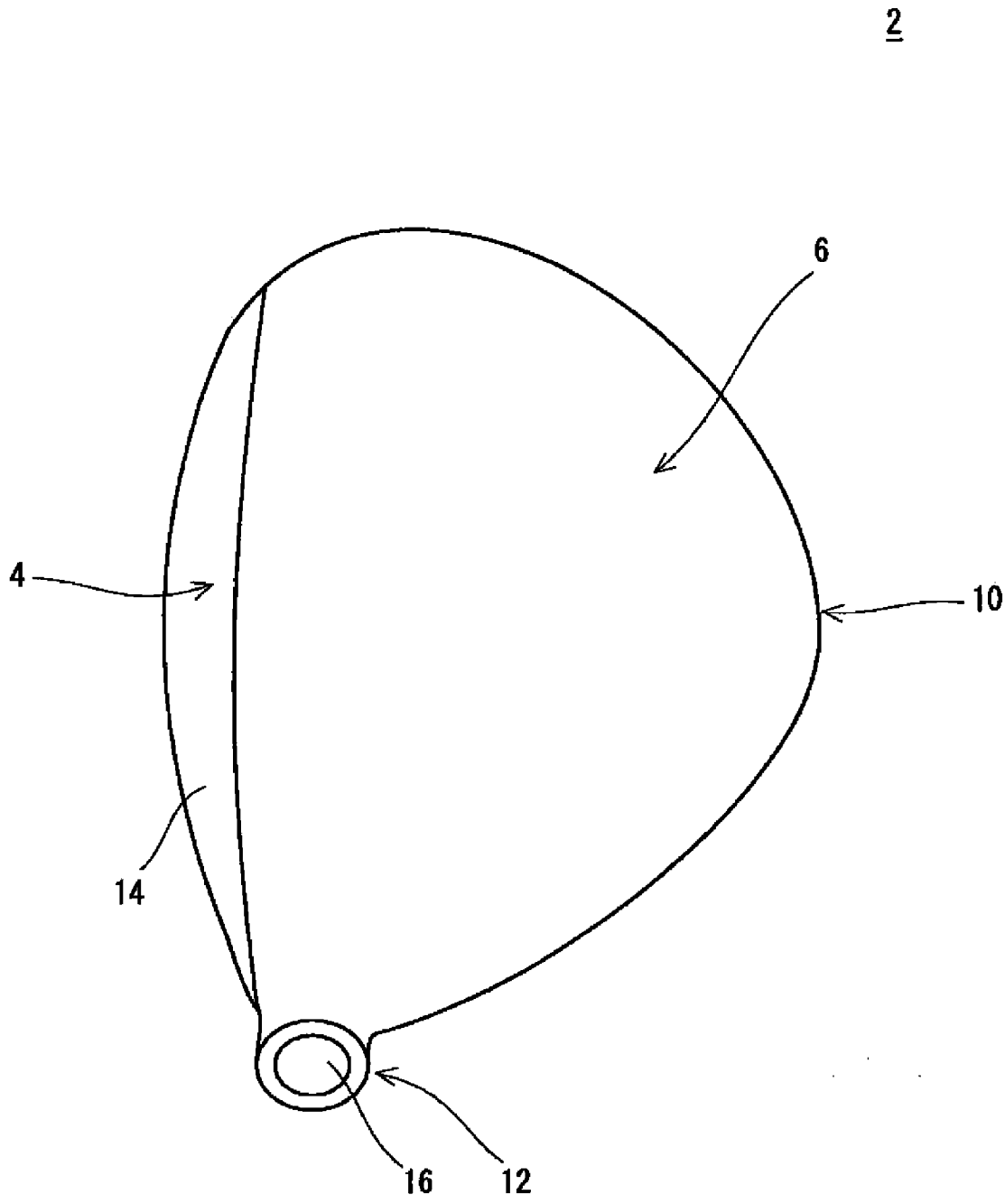
FIG. 2 shows a view illustrating the head shown in FIG. 1 viewed from the crown side.

As shown in FIG. 1 and FIG. 2, head 2 has face member 4, crown member 6, sole member 8, side member 10 and hosel part 12. The side member 10 extends between the crown member 6 and the sole member 8. The face member 4 has hit face 14. The hit face 14 is also referred to as a face surface. The external surface of the face member 4 is the hit face 14. A part having the hit face 14 as its external surface is the face member 4. Upon hitting, the hit face 14 is in contact with a ball. As shown in FIG. 2, the hosel part 12 has shaft hole 16. A shaft is inserted into and adhered to the shaft hole 16. A golf club is fabricated by attaching the shaft and a grip to the head 2.

Figure 3:
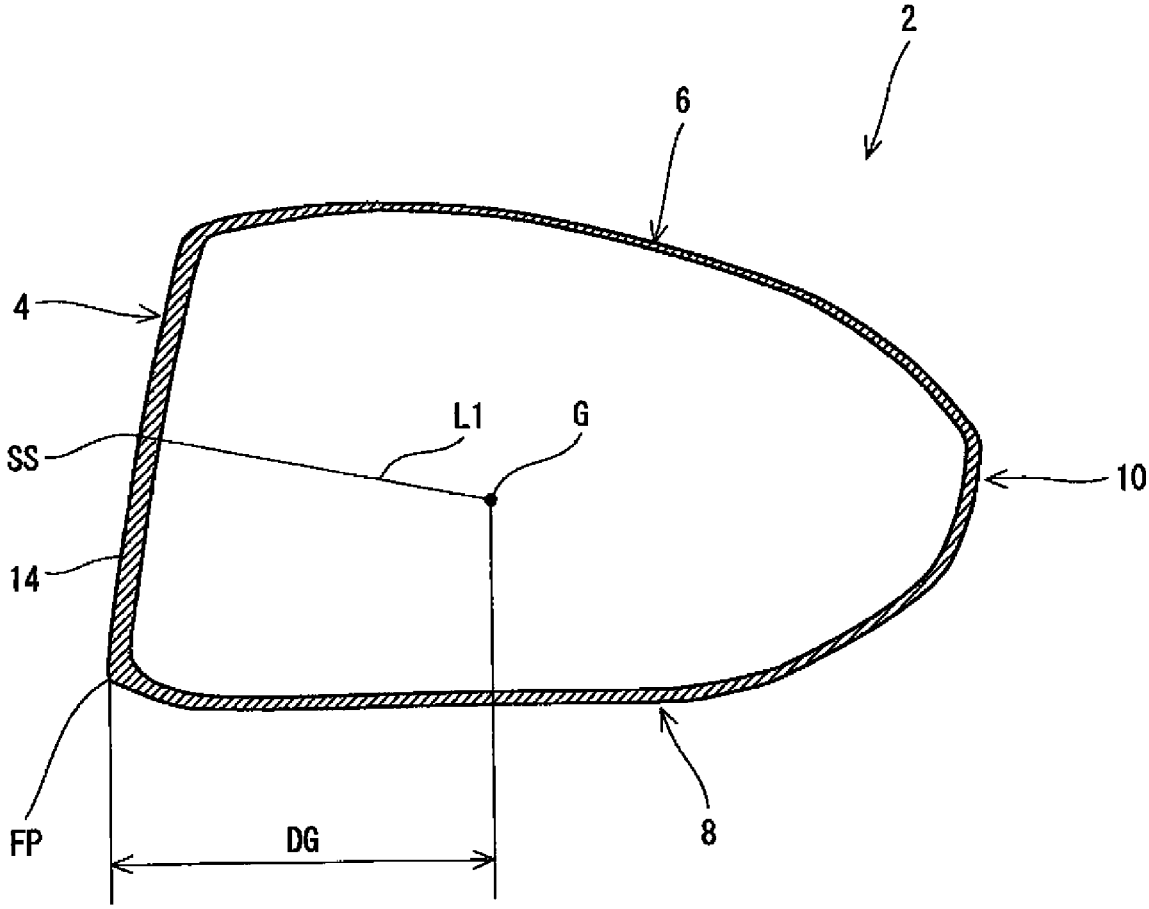
FIG. 3 shows a cross-sectional view of the head shown in FIG. 1.

FIG. 3 shows a cross-sectional view taken along a plane including a center of gravity G of the head and a sweet spot SS. As shown in FIG. 3, the head 2 is hollow. The center of gravity G of the head is positioned in the hollow part. The sweet spot SS is an intersecting point formed with the hit face 14 and a straight line L1 drawn from the center of gravity G of the head toward the hit face 14. The straight line L1 is a normal line of the hit face 14 at the sweet spot SS.

Figure 4:
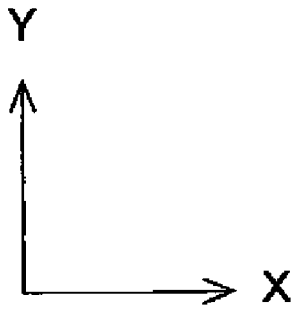
FIG. 4 shows an explanatory view for illustrating the boundary of the hit face.
Figure 4:
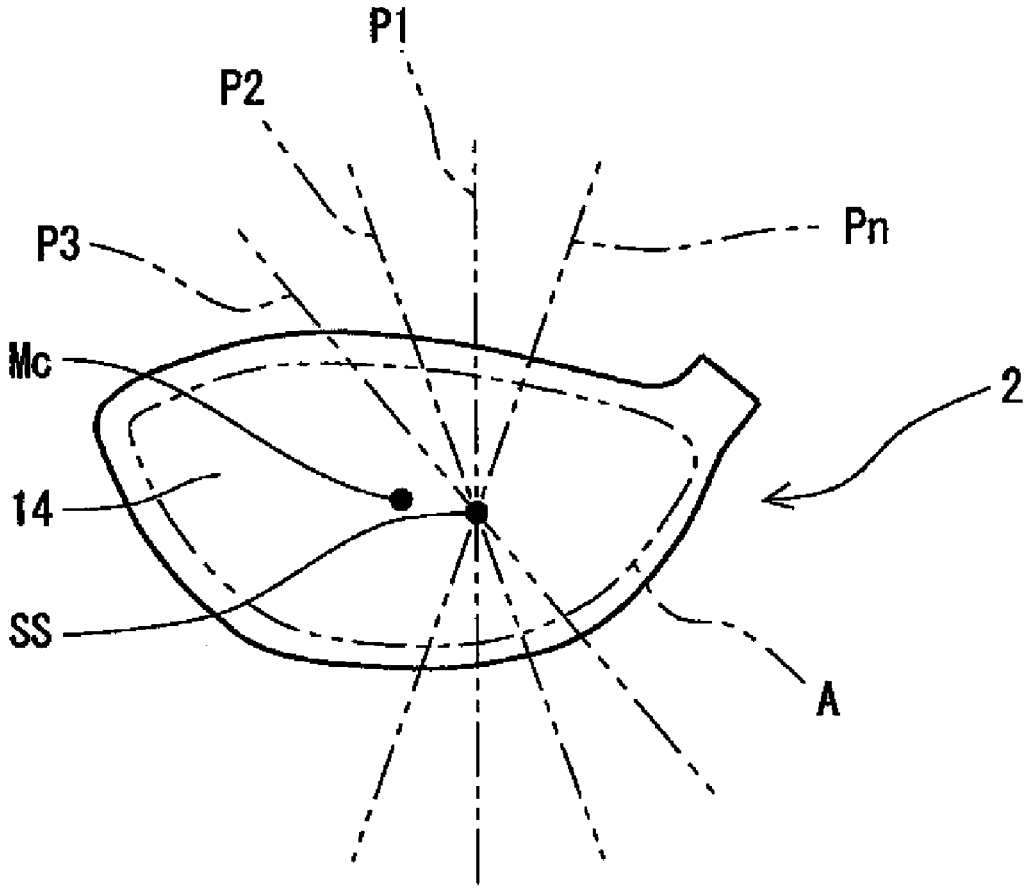

FIG. 4 shows a front view illustrating the head 2 shown in FIG. 1. In FIG. 4, the face member 4 is shown in the state in which the head 2 is placed on the horizontal ground such that the axis line of the shaft hole 16 is located within the vertical plane, and the lie angle and the hook angle have a predetermined value (reference state). In this FIG. 4, the direction oriented from the left toward the right (horizontal direction) corresponds to the X direction, while the direction oriented from the bottom toward the top (vertical direction) corresponds to the Y direction, and the direction that is perpendicular to the graph sheet is the hitting direction. The predetermined values of the lie angle and hook angle can be, for example, as described in a product catalog.

Figure 5:
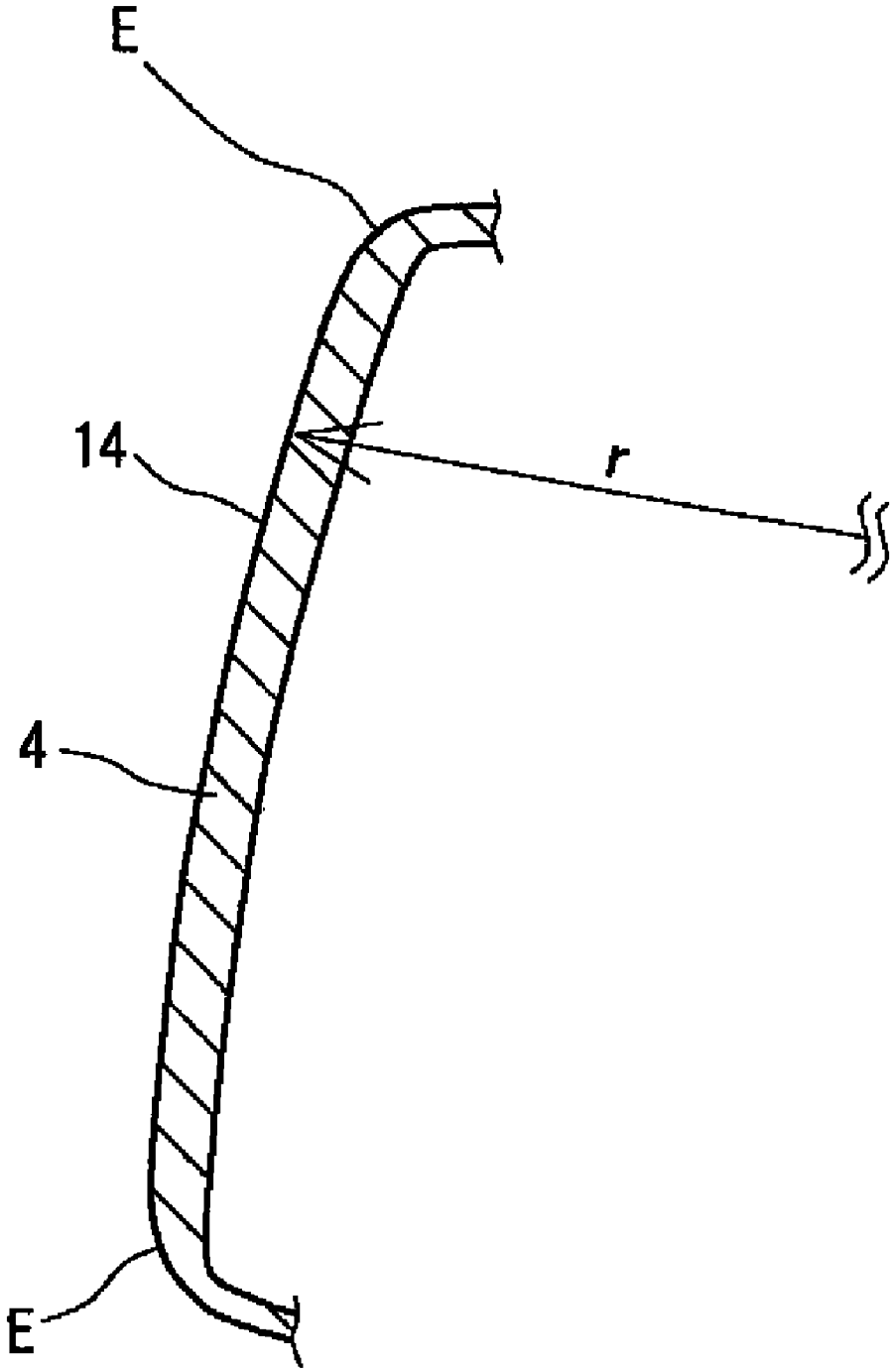
FIG. 5 shows a cross-sectional view for illustrating the boundary of the hit face.

In this FIG. 4, the region surrounded by the chain double-dashed line A is the hit face. The hit face is defined as a region surrounded by the edge when the edge can be visually specified by its clear ridge or the like. When the boundary of the face member 4 and other part is not clear due to being rounded (being added roundness), numerous planes P1, P2, P3, to Pn including straight line L1 that connects between the center of gravity G of the head and the sweet spot SS are first defined as shown by the chain double-dashed line in FIG. 4. On each cross section along these planes, as shown in FIG. 5, the curvature radius r of the external surface of the head 2 is determined. The curvature radius r is continuously determined from the center of the hit face 14 toward the outward direction (upward direction and downward direction in FIG. 5). In the determination, the part E where the curvature radius r of no longer than 200 mm is first attained is defined as edge. The region surrounded by the edge E determined based on the numerous planes P1, P2, P3, to Pn corresponds to the hit face 14. Upon the determination of the curvature radius r, face line, punch marks and the like are assumed not to be present.

Figure 6:
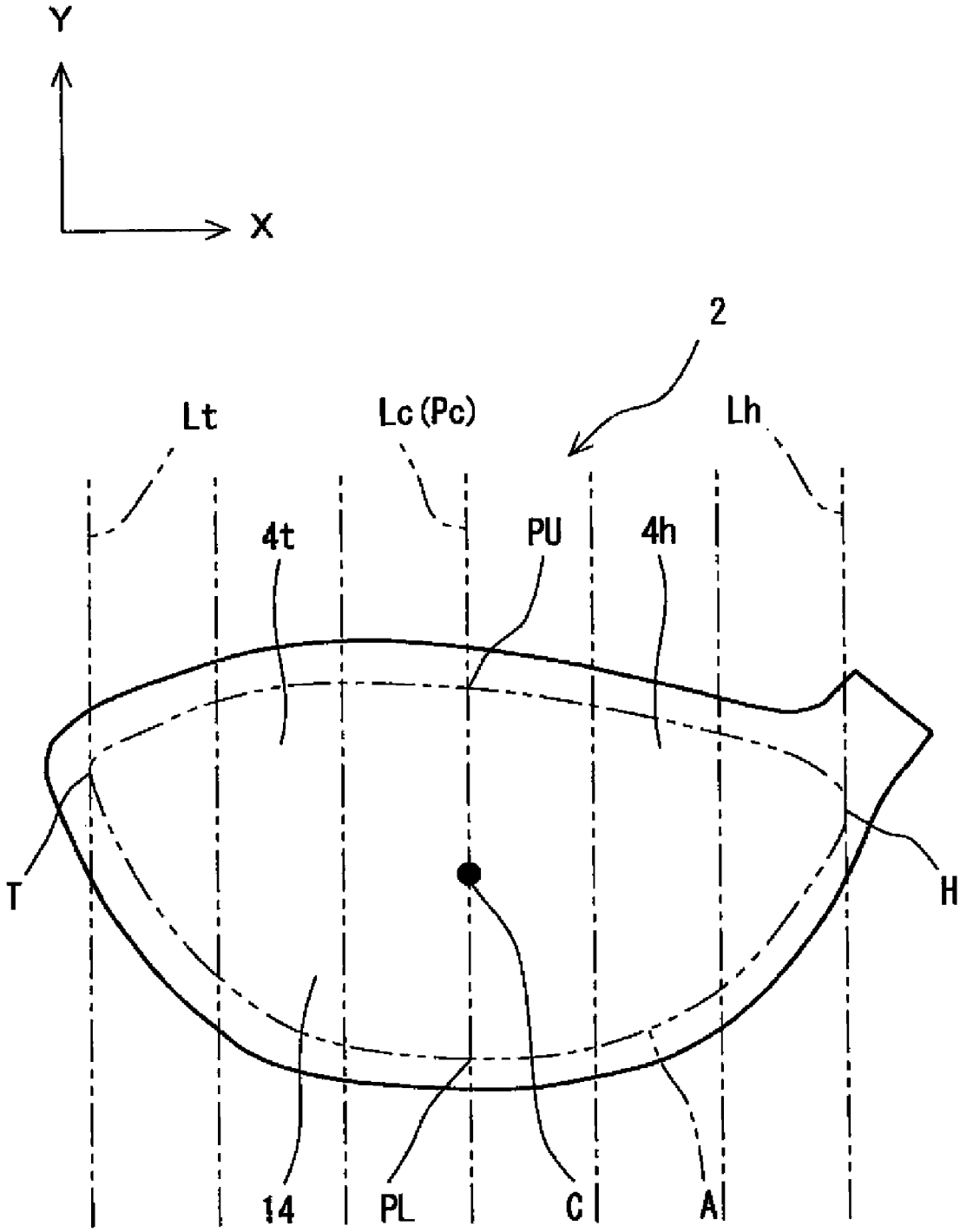
FIG. 6 shows a view illustrating the head shown in FIG. 1 viewed from the face side.

FIG. 6 shows an enlarged view illustrating the head 2 shown in FIG. 4. In this FIG. 6, what is indicated by the reference sign T is toe side point. This toe side point T is positioned at the leftmost (most toe side) of the hit face. The straight line Lt passes the toe side point T and extends in the vertical direction. What is indicated by the reference sign H is a heel side point. This heel side point H is positioned at the rightmost (most heel side) of the hit face. The straight line Lh passes the heel side point H and extends in the vertical direction. The straight line Lc is parallel to the straight line Lt and the straight line Lh. The distance between the straight line Lc and the straight line Lt is equal to the distance between the straight line Lc and the straight line Lh. What is indicated by the reference sign PU is the upside point, while what is indicated by the reference sign PL is the downside point. Both the upside point PU and the downside point PL are an intersection of the straight line Lc and the chain double-dashed line A. What is indicated by the reference sign C is the center of the hit face, which may be also referred to as hit face center hereinafter. The center C is a midpoint of the line segment that connects the point PU and the point PL. In this FIG. 6, the center C is specified as the origin of the XY coordinate system. In other words, the coordinate of the center C is (0, 0). The X axis of the XY coordinate system runs along the X direction. The Y axis of the XY coordinate system runs along the Y direction. The position closer to the heel side edge has a greater value of the X coordinate. The position closer to the crown side edge has a greater value of the Y coordinate.

The head 2 has a maximum resilience point Mc. As shown in FIG. 4, the maximum resilience point Mc is present on the hit face 14. The positions of the maximum resilience point Mc and the sweet spot SS shown in FIG. 4 are one example of an aspect of the present invention.

Among the points on the hit face 14, the maximum resilience point Mc is a point where the maximum resilience coefficient is attained. The resilience coefficient is determined according to the process for measuring COR (Procedure for Measuring the Velocity Ratio of a Club Head for Conformance to Rule 4-1e, Revision 2 (Feb. 8, 1999)) provided by U.S.G.A. (United States Golf Association). The measurement point can be any point, for example, where the value (mm) of the X coordinate and the value (mm) of the Y coordinate are an integer number. The maximum resilience point Mc can be a point where the maximum resilience coefficient is attained among these measurement points.

In the head 2, the sweet spot SS and the maximum resilience point Mc are present at different positions. In the head 2, the coordinate of the sweet spot SS is defined as (x1, y1), while the coordinate of the maximum resilience point Mc is defined as (x2, y2). In this head, x1 may be +3 mm or greater and +8 mm or less, while x2 may be −5 mm or greater and +2 mm or less.

Conventionally, to locate the maximum resilience point Mc in the vicinity of the sweet spot SS has been a common technical knowledge to persons skilled in the art. Contrary to this common technical knowledge, the coordinate of the sweet spot SS, and the coordinate of the maximum resilience point Mc are defined as explained above in this embodiment. The sweet spot SS is positioned on the side closer to the heel than the maximum resilience point Mc is.

The present inventor found a problem caused by the location of the maximum resilience point Mc in the vicinity of the sweet spot SS. According to the present invention, by keeping the sweet spot SS away from the maximum resilience point Mc, distinct effects from the Prior Art can be exhibited.

As described above, x1 is defined to be +3 mm or greater and +8 mm or less. The sweet spot SS positioned on the side closer to the heel than the center of the hit face C is. By thus displacing the center of gravity G of the head to the heel side, the sweet spot SS can be also shifted to the heel side. According to common technical knowledge, when the sweet spot SS is displaced to the heel side, the maximum resilience point Mc is also displaced to the heel side. The head 2 defies this technical knowledge. More specifically, although x1 is defined to be +3 mm or greater and +8 mm or less, x2 is defined to be −5 mm or greater and +2 mm or less. The maximum resilience point Mc is positioned on the side closer to the toe than the sweet spot SS is.

By the positioning of the sweet spot SS close to the heel, the face becomes apt to be returned. The "return of the face" is a term generally known to persons skilled in this art, and means that "open face is closed". In downward swinging, the face is open before the impact. For the purpose of providing a square face upon impact, it is necessary to sufficiently return the face prior to the impact. The square impact can yield a straight trajectory of the hit ball. The square impact can improve the directionality of the hit ball, and increases the flight distance. When the face does not return enough, the face opens upon impact. The open face upon impact may result in slice. The slice may reduce the flight distance and directionality of the hit ball. By defining x1 to be +3 mm or greater and +8 mm or less, the face is apt to be returned, and thus the square face is likely to be achieved upon impact.

Whereas, in regard to the maximum resilience point Mc, x2 is defined to be −5 mm or greater and +2 mm or less. As described above, the X coordinate of the center of the hit face C is 0. Therefore, in regard to the X coordinate, the maximum resilience point Mc is closer to the hit face center C than the sweet spot SS is.

Of course, impact points effected by the golf players will vary. Meanwhile, with regard to the X direction, the golf player makes an effort to hit the ball at a point as close to the center C of the hit face as possible. As a result, the distribution center of the impact points effected by the golf players with respect to the X direction is likely to be near the center of the hit face C. As the X coordinate of the maximum resilience point Mc is approximate to 0, higher resilience coefficient is likely to be obtained. When the resilience coefficient is high, a great flight distance is likely to be obtained. The value of x2 falling within the range of −5 mm or greater and +2 mm or less is responsible for increase in average flight distance.

According to the common knowledge in prior arts, the maximum resilience point Mc is close to the sweet spot SS. According to the common knowledge in prior arts, when the sweet spot SS is positioned close to the heel, the maximum resilience point Mc will also get close to the heel. Although the face is likely to be returned in this case, the maximum resilience point Mc is likely to be away from the hit face center C. When the maximum resilience point Mc is away from the hit face center C, the impact point effected by the golf player is likely to be away from the maximum resilience point Mc. The maximum resilience point Mc that is away from the hit face center C likely results in decrease in the flight distance. According to the common knowledge in prior arts, it is difficult to concomitantly achieve both ease in returning of the face and the flight distance. The present invention can solve such problems.

The positioning of the sweet spot SS close to the heel can result in achievement of an additional effect. Although the resilience coefficient at the sweet spot SS is lower than the resilience coefficient at the maximum resilience point Mc, it is comparatively high among respective points other than the maximum resilience point Mc. Hitting at the sweet spot SS can attain a great flight distance. In the head according to the present invention, the parts having a high resilience coefficient can be dispersed to the maximum resilience point Mc and the sweet spot SS. The impact point effected by the golf player will be accompanied by variance (distribution). Due to this variance, constant flight distance cannot be attained by the golf player. The positioning of the maximum resilience point Mc away from the sweet spot SS can elevate the average flight distance attained by the golf player. The average flight distance is a mean value of the flight distances by hitting multiple times.

During single operation of swinging, the head speed of the heel of the face is generally known to be smaller than the head speed of the toe of the face. This results from the radius of rotation of the toe generated by the swing being greater than that of the heel. Therefore, at the impact with the same golf club by the same swing, the head speed of the heel is smaller than that of the toe at the impact point when compared in the case in which the impact point is positioned on the heel and the case in which the impact point is positioned on the toe. Resulting from the difference in the head speed, the flight distance attained by the impact on the heel is liable to be inferior. The present invention can solve such a problem. By the positioning of the sweet spot SS close to the heel, the resilience coefficient upon hitting on the heel is increased, whereby the flight distance attained by hitting at heel can be increased.

Upon impact of the club head with the ball, the head can be rotated. Resulting from this rotation of the head, the head imparts a moment that allows the ball to rotate in a direction that is reverse to rotation of the head. This phenomenon is generally referred to as a gear effect. When the impact point is positioned on the toe or heel, the side spin can be generated due to the gear effect. This side spin can lead to occurrence of hook or slice. Particularly, when the impact point is positioned on the heel, the slice is liable to occur due to the gear effect. When the impact point is away from the sweet spot SS, the gear effect is enhanced. By defining the value of x1 to fall within the above range, the gear effect is deteriorated when the impact point is positioned on the heel. Owing to deterioration of the gear effect, the side spin is reduced, whereby the flight distance can be increased.

Meanwhile, when the sweet spot SS is positioned close to the heel, and the impact point is positioned on the toe, the impact point is likely to be away from the sweet spot SS. Therefore, when the impact point is positioned on the toe, the gear effect is likely to be enhanced. This great gear effect results in a great hook spin. The hook spin is a side spin that causes hook. This hook spin results in a draw ball. The draw ball is responsible for increase in the flight distance. In addition, when the impact point is away from the sweet spot SS, the rotation of the head is increased, whereby the ball is launched toward the slice orientation. The slice orientation means an orientation of the ball that is directed in the case of slice, and means the right-hand direction when the golf player is a right-handed person. When the sweet spot SS is positioned close to the heel, and the impact point is positioned close to the toe, the ball is launched toward the slice orientation, and is apt to drop in a target direction due to the draw ball. The golf club head of the present invention is excellent in the flight distance and directionality of the hit ball also in the case in which the impact point is positioned on the toe. Additionally, it is common sense to persons skilled in the art that the draw ball is beneficial in increasing the flight distance.

In FIG. 3, what is indicated by the both-oriented arrowhead DG is the depth of the center of gravity of the head 2. In the present invention, the depth of the center of gravity DG can be measured as follows. In the head in the reference state, a head cross section S is specified by a vertical face including the straight line L1. FIG. 3 shows this head cross section S. In the head cross section S, a horizontal distance between the forefront point Fp of the head and the center of gravity G of the head is determined as the depth of the center of gravity DG.

The shortest distance D1 between the axis line of the shaft hole z1 and the center of gravity G of the head is also referred to as the distance to the center of gravity by the persons skilled in the art. Hereinafter, the shortest distance D1 is also referred to as the distance D1 to the center of gravity.

The distance D1 to the center of gravity correlates to the position of the sweet spot SS, and the depth DG of the center of gravity. Greater depth DG of the center of gravity tends to result in a greater distance D1 to the center of gravity. When the sweet spot SS is positioned closer to the toe, the distance D1 to the center of gravity is likely to be increased. As the distance D1 to the center of gravity is excessively small, the sweet spot SS may get too close to the heel, or the depth DG of the center of gravity tends to be too small. In light of rendering the coordinate x1 of the sweet spot SS and the depth DG of the center of gravity fall within a preferable range, the distance D1 to the center of gravity is preferably equal to or greater than 33 mm, more preferably equal to or greater than 35 mm, and particularly preferably equal to or greater than 37 mm. In light of suppression of excessive moment of inertia of the head around the shaft axis, and improvement of the return of the head, the distance D1 to the center of gravity is preferably equal to or less than 44 mm, more preferably equal to or less than 43 mm, and still more preferably equal to or less than 40 mm.

In FIG. 6, what is indicated by the symbol Pc is a plane that passes the center C of the hit face, is parallel to the Y direction, and is perpendicular to the X direction. This plane Pa includes the straight line Lc. The plane Pc divides the face member 4 into toe portion 4*t*, and heel portion 4*h*. The area mean thickness Tt of the toe portion 4*t* is less than the area mean thickness Th of the heel portion 4*h*. In other words, they are represented by the formula of Tt<Th. The thin part is apt to be bent upon hitting. The thick part is resistant to bending upon hitting. Resulting from such difference in the bending, the maximum resilience point Mc can displace to the side having a smaller thickness. Furthermore, by making the thicknesses satisfy the formula of Tt<Th, the center of gravity G of the head is apt to be shifted to the heel side, and concomitant therewith, the sweet spot SS is also apt to be shifted to the heel side. Thus, by making the thicknesses satisfy the formula of Tt<Th, the maximum resilience point Mc is allowed to get closer to the hit face center C while positioning the sweet spot SS close to the heel. Accordingly, by making the thicknesses satisfy the formula of Tt<Th, the coordinate x1 and the coordinate x2 can fall within the above range.

Upon the measurement of the area mean thickness Tt and the area mean thickness Th, joining part of the face member 4 and the part other than the face member 4 is excluded. The part other than the face member 4 corresponds to sole member 8, crown member 6, side member 10 and the like. The area mean thickness can be determined according to the following formula from the area S1 of the external surface of the measurement part, the area S2 of the inner face of the measurement part, and the volume V1 of the measurement part:

$$(\text{area mean thickness})=V1/[(S1+S2)/2].$$

As alternatives for constituting so as to achieve the positioning of the maximum resilience point Mc close to the hit face center C while positioning the sweet spot SS close to the heel, the following options (1) and (2) may be adopted as well as the aforementioned option. The following options (1) and (2) allow the toe portion to be more flexible than the heel portion.

(1) The height of the toe portion of the face member 4 is elevated to be greater than the height of the heel portion of the face member 4.

(2) The Young's modulus of the toe portion of the face member 4 is decreased to be less than the Young's modulus of the heel portion of the face member 4.

As a method for realizing the aforementioned option (2), the following (2a) and (2b) may be suggested.

(2a) A different material is used at the toe portion of the face member 4 from the material used at the heel portion of the face member 4.

(2b) The toe portion of the face member 4 and the heel portion of the face member 4 are integrally formed, but different specifications of the thermal treatment of the toe portion and the heel portion are employed.

In light of possibility of enhancing the strength of the face member while avoiding the joint between the different materials, the method (2b) is more preferable than the method (2a). The specifications of the thermal treatment in the method (2b) include temperature of the thermal treatment, time period of the thermal treatment, and the like. The procedure for the thermal treatment which can be employed includes overall heating such as heating in a hot oven or the like, or local heating with a laser, burner or the like. The overall heating may be also carried out while cooling a part of the face member. Because it would be easy to allow the specification of the thermal treatment to vary in part, the local heating is preferred. Also, for the purpose of carrying out the local thermal treatment more effectively, it is also preferred that the local heating be conducted while cooling the part which is not subjected to the local heating.

For the constitution for achieving the positioning of the sweet spot SS close to the heel, the following options (3) to (7) may be employed.

(3) The weight distribution of the whole head is regulated. For example, the part close to the heel of the head may be thickened; the part close to the toe of the head may be thinned; or a weight member may be disposed at a site close to the heel of the head; or the like.

(4) With respect to the shape of the contour of the face, the part close to the heel is expanded than the part close to the toe.

(5) A material having a less specific gravity is used in the part close to the toe of the head. Alternatively, a material having a greater specific gravity is used in the part close to the heel of the head.

(6) A material having a less specific gravity is complexed in the part close to the toe of the head. Alternatively, material having a greater specific gravity is complexed in the part close to the heel of the head.

(7) As described above, the area mean thickness Tt is made less than the area mean thickness Th.

In light of enhancing the effect described above achieved by positioning the sweet spot SS close to the heel, the coordinate x1 is preferably equal to or greater than +3 mm, more preferably equal to or greater than +3.5 mm, and still more preferably equal to or greater than +4.0 mm. When the excessive side spin is generated due to the excessive gear effect, the hit ball may greatly curve, whereby the flight distance and the directionality of the hit ball are likely to be deteriorated. In light of suppression of the excessive gear effect upon hitting close to the toe, thereby improving the flight distance and the directionality of the hit ball, the coordinate x1 is preferably equal to or less than +8 mm, more preferably equal to or less than +7 mm, and still more preferably equal to or less than +6 mm.

In light of achieving the positioning of the maximum resilience point Mc close to the hit face center C, and thereby improving the resilience performance upon hitting close to the heel, the coordinate x2 is preferably equal to or greater than −5 mm, more preferably equal to or greater than −4 mm, and still more preferably equal to or greater than −3 mm. In light of making the maximum resilience point Mc away from the sweet spot SS, and thereby improving the resilience upon hitting close to the toe, the coordinate x2 is preferably equal to or less than +2 mm, more preferably equal to or less than +1.5 mm, and still more preferably equal to or less than +1 mm.

In light of making the sweet spot SS away from the maximum resilience point Mc, the value of the difference (x1−x2) is preferably equal to or greater than 3 mm, and more preferably equal to or greater than 4 mm. When the sweet spot SS is too far away from the maximum resilience point Mc, the sweet spot SS is liable be too close to the heel, or the maximum resilience point Mc is liable to be too close to the toe. In this respect, the value of the difference (x1−x2) is preferably equal to or less than 8 mm, and more preferably equal to or less than 7 mm.

The gear effect described above concerns the side spin. In contrast, a gear effect with respect to the back spin can also be caused. This gear effect can be caused when the impact point is shifted in the vertical direction. The gear effect which can increase or decrease the back spin is also referred to longitudinal gear effect hereinbelow. When the impact point is displaced downward, the back spin can be increased due to the longitudinal gear effect. When the impact point is displaced upward, the back spin can be decreased due to the longitudinal gear effect.

According to the investigations made by the present inventor, it was revealed that the impact points effected by the golf player often distribute in the range of the Y coordinate of from 0 mm to +3 mm, upon hitting after teeing up. When the Y coordinate of the sweet spot SS is too far away from this impact point, excessive longitudinal gear effect can be caused. When the coordinate y1 is too small, the back spin is likely to be excessively decreased due to the excessive longitudinal gear effect. When the back spin rate is excessively decreased, the trajectory may be excessively low, whereby so-called dropping ball is attained, leading to decrease in the flight distance. In this respect, the coordinate y1 is preferably equal to or greater than −3 mm, more preferably equal to or greater than −2 mm, and still more preferably equal to or greater than −1 mm. When the back spin rate is excessively increased due to the excessive longitudinal gear effect, too high trajectory may be attained, thereby leading to decrease in the flight distance. In this respect, the coordinate y1 is preferably equal to or less than +7 mm, more preferably equal to or less than +6 mm, and still more preferably equal to or less than +5 mm. So called drivers (#1 wood) are usually used after teeing up for hitting the ball. The real loft of the head for drivers is usually from 6 degrees to 15 degrees. The length of the driver is usually from 43 inches to 48 inches.

By positioning the maximum resilience point Mc in the vicinity of the impact point effected by the golf player, the average flight distance can be improved In case of hitting after teeing up, the coordinate y2 is preferably equal to or greater than −3 mm, more preferably equal to or greater than −2 mm, still more preferably equal to or greater than −1 mm, and yet more preferably equal to or greater than 0 mm, in light of positioning of the impact point close to the maximum resilience point Mc. In light of positioning of the impact point close to the maximum resilience point Mc upon hitting the ball after teeing up, the coordinate y2 is preferably equal to or less than +7 mm, more preferably equal to or less than +5 mm, and still more preferably equal to or less than +3 mm.

When the coordinate y1 is too small, the longitudinal gear effect may excessively lower the trajectory. In contrast, when the coordinate y2 is too large, the resilience coefficient may be reduced since the impact point is away from the maximum resilience point Mc. In these respects, the difference (y1−y2) is preferably equal to or greater than −6 mm. When the coordinate y1 is too great, the back spin rate may be excessively increased due to the longitudinal gear effect, whereby the flight distance may be reduced. Also, when the coordinate y2 is too small, the impact point may be too far away from the maximum resilience point Mc, whereby the resilience coefficient may be reduced. In these respects, the difference (y1−y2) is preferably equal to or less than +6 mm.

In light of improving the gear effect so as to allow the ball, which was hit at a position close to the toe and launched toward the slice orientation, to turn back along the target direction the depth DG of the center of gravity is preferably equal to or greater than 36 mm, more preferably equal to or greater than 38 mm, and still more preferably equal to or greater than 40 mm. When the center of gravity G of the head is too away from the face member, the stability of the face may be deteriorated, whereby inferior directionality may be attained. In this respect, the depth DG of the center of gravity is preferably equal to or less than 55 mm, more preferably equal to or less than 50 mm, and still more preferably equal to or less than 44 mm.

In light of enhancement of the strength of the face member, the area mean thickness Tt is preferably equal to or greater than 1.5 mm, more preferably equal to or greater than 1.8 mm, and still more preferably equal to or greater than 2.0 mm. In light of increase in the difference (x1−x2), and improving the resilience coefficient, the area mean thickness Tt is preferably equal to or less than 3.0 mm, more preferably equal to or less than 2.6 mm, and still more preferably equal to or less than 2.4 mm.

In light of increase in the difference (x1−x2), and enhancement of the strength of the face member, the area mean thickness Th is preferably equal to or greater than 1.5 mm, more preferably equal to or greater than 1.9 mm, and still more preferably equal to or greater than 2.3 mm. In light of improving the resilience coefficient through suppressing the excessive increase in the rigidity of the face member, the area mean thickness Th is preferably equal to or less than 3.5 mm, more preferably equal to or less than 3.0 mm, and still more preferably equal to or less than 2.7 mm.

In light of increase in the difference (x1−x2), the difference (Th−Tt) is preferably equal to or greater than 0.1 mm, more preferably equal to or greater than 0.2 mm, and still more preferably equal to or greater than 0.4 mm. In light of preventing the area mean thickness Tt from becoming excessively thin, or preventing the area mean thickness Th from becoming excessively thick, the difference (Th−Tt) is preferably equal to or less than 1.0 mm, more preferably equal to or less than 0.8 mm, and still more preferably equal to or less than 0.6 mm.

In light of improvement of sense of stability in appearance in addressing, and increase in the depth DG of the center of gravity and the moment of inertia, the head volume is preferably equal to or greater than 350 cc, more preferably equal to or greater than 380 cc, still more preferably equal to or greater than 400 cc, and yet more preferably equal to or greater than 420 cc. In light of compliance with Golf Rules (Appendix II-b) defined by Japan Golf Association, the head volume is preferably equal to or less than 470 cc, and more preferably equal to or less than 460 cc.

In light of enhancement of the strength while enlarging the head, as well as optimization of the swing balance, and improvement of the resilience coefficient, the head weight is preferably equal to or greater than 180 g, and more preferably equal to or greater than 185 g. In light of improvement of the flight distance and directional stability for providing a golf club which can be easily swung through, the head weight is preferably equal to or less than 220 g, and more preferably equal to or less than 215 g.

The head can be produced by joining multiple members. The head structure obtained by joining two members is referred to as a two-piece structure. The head structure obtained by joining three members is referred to as a three-piece structure. The head structure obtained by joining four members is referred to as a four-piece structure. In the present invention, the structure of the head is not limited. The structure of the head may be any of the two-piece structure, three-piece structure, four-piece structure, and structures with five or more pieces. Illustrative examples of the two-piece structure include structures having a head main body and a face member, structures having a head main body and a sole member, structures having a head main body and a crown member, and the like. Illustrative examples of the three-piece structure include structures having a head main body, a face member and a neck member, structures having a head main body, a face member and a crown member, structures having a head main body, a face member and a sole member, and the like. Illustrative examples of the four-piece structure include structures having a head main body, a face member, a crown member and a neck member. Method of manufacturing each member (each piece) is not limited. As the method of manufacturing each member, casting, forging, pressing or any combination thereof can be employed.

The material that constitutes the head is not limited. As the material, one or more selected from the group consisting of stainless steel, Maraging steel, titanium, titanium alloys, magnesium alloys, aluminum alloys and fiber reinforced resins can be employed.

EXAMPLES

Hereinafter, advantages of the present invention will be explained by way of Examples, however, the present invention should not be construed as being limited based on the description of the Examples.

Comparative Example A

Using a head main body and a face member, a head having a two-piece structure was produced. The head main body was produced by a precision casting process. The material of the head main body was Ti-6Al-4V. For the face member, a ($\alpha$+$\beta$) titanium alloy was used. The face member was produced by NC processing of a rolled titanium alloy, followed by press processing. The material of the face member was SP700 manufactured by JFE Steel Corporation. This material SP700 is a ($\alpha$+$\beta$) titanium alloy. This material SP700 is a titanium alloy containing from 4.00% by weight to 5.00% by weight of aluminum, from 2.50% by weight to 3.50% by weight of vanadium, from 1.80% by weight to 2.20% by weight or molybdenum, and from 1.70% by weight to 2.30% by weight of iron, and the like.

The shape of the head was as illustrated in FIG. 1. This head is for right-handed players. The sole member had a thickness of 0.9 mm. The side member and the crown member had a wall thickness of 0.7 mm. The face member had a thickness of 3.2 mm at the center thereof, and of 2.2 mm at the edge part. The head main body was welded with the face member to obtain a head. The welding employed was plasma welding. The head weight was 195 g. This head had a real loft angle of 11 degrees. This head is so called a head for drivers. The coordinate (x1, y1) of the sweet spot SS was (0, +3). The coordinate (x2, y2) of the maximum resilience point Mc was (0, +2). The coordinate is represented by a unit of mm. A shaft and a grip were attached to this head to obtain a golf club having a length of 45 inches. Specifications and evaluation results of Comparative Example A are shown in Table 1 below.

Examples 1 to 9 and Comparative Examples 1 to 3

The head and the golf club of Examples 1 to 9 and Comparative Examples 1 to 3 were obtained in a similar manner to Comparative Example A except that the thickness of each part of the head was adjusted to have the specifications as shown in Table 1. The coordinate of the maximum resilience point Mc was adjusted by equally dividing the face member into six sections in the direction of from the toe to the heel, and arbitrarily changing the thickness of these six sections. FIG. 6 illustrates the lines that equally divide the face member into six sections by chain double-dashed lines. The position of the sweet spot SS was adjusted by entirely or partially altering the thickness of the sole member and the side member. Specifications and evaluation results of each example are shown in Table 1 below.

Evaluation by Swing Robot

The golf club of each example was attached to a swing robot, and hitting with this club was executed at a head speed of 40 m/s. The direction of the face was set such that the ball flies in an approximately target direction when the hitting of the ball at the center C of the hit face was allowed. Ten balls were hit with three kinds of impact points, respectively, and thus attained flight distance was measured. The coordinate of the three kinds of impact points were (−20, 0), (0, 0) and (+20, 0). The hitting at the coordinate (−20, 0) is shown in Table 1 below in the column of "hitting at toe 20 mm". The hitting at the coordinate (0, 0) is shown in Table 1 below in the column of "hitting at hit face center". The hitting at the coordinate (+20, 0) is shown in Table 1 below in the column of "hitting at heel 20 mm". The flight distance is a travel distance (total flight distance) measured at the point where the hit ball stopped. Average values of the ten balls are shown in Table 1 below in the column of "flight distance".

For the purpose of evaluating the directionality of the hit ball, the distance between the point where the ball stopped, and a straight line connecting the target point and the launch point was measured. This distance was represented by a plus value when the measurement point is located on the right side with respect to the target direction, while it was represented by a minus value when the measurement point is located on the left side with respect to the target direction. Average values of determined values on the ten balls are shown in Table 1 below in the column of "deviation in right and left direction". When the value of the "deviation in right and left direction" is minus and its absolute value is larger, greater deviation in the left direction with respect to the target direction is suggested. When the value of the "deviation in right and left direction" is plus and its absolute value is larger, greater deviation in the right direction with respect to the target direction is suggested.

Evaluation by Tester

Evaluation was made by ten golf players. Handicap of the ten golf players was in the range of 15 or greater and 30 or less. Each golf player hit with the club of each example, and evaluated on ease in capture, and directionality of the ball. All testers were right-handed.

Five-grade evaluation of the "ease in capture" was made by a five-point method. The evaluation standards are as follows. Average values of the evaluation scores by the ten players are shown in Table 1 below.

Point 5: easy in capture;
Point 4: somewhat easy in capture;
Point 3: neither easy nor difficult in capture;
Point 2: somewhat difficult in capture; and
Point 1: difficult in capture.

Herein, the term "difficult in capture" means a state in which the face is hard to return to square upon impact, whereby the impact is likely perfected with the face open. The club that is "difficult in capture" is likely to make the hit ball slice. To the contrary, the term "easy in capture" means that the face is easily returned. Many golf players have a trouble of slice of the hit balls. As for many golf players, the hit ball is apt to fly in the target direction with the club that is "easy in capture". Many golf players shall make higher evaluation on the club that is "easy in capture". Better evaluation is made on the "ease in capture" as a higher point is scored.

With respect to the "directionality of the ball", five-grade evaluation was made by a five-point method. The evaluation standards are as follows. Average of the evaluation scores by the ten players is shown in Table 1 below. Better evaluation is made as the score point is approximate to Point 3.

Point 5: hook;
Point 4: sometimes hook;
Point 3: fly almost straight;
Point 2: sometimes slice; and
Point 1: slice.

Table 1

TABLE 1

Specifications and Evaluation Results of Examples and Comparative Examples

| | Comparative ExampleA | Example1 | Example2 | Example3 | Comparative Example1 | Comparative Example2 | Example4 |
|---|---|---|---|---|---|---|---|

TABLE 1-continued

Specifications and Evaluation Results of Examples and Comparative Examples

| | | | | | | | | | |
|---|---|---|---|---|---|---|---|---|---|
| Distance D1 to the center of gravity | | (mm) | 40 | 41 | 39 | 37 | 36 | 40 | 39 |
| Coordinate x1 | | (mm) | 0 | 3 | 5 | 8 | 11 | 5 | 5 |
| Coordinate x2 | | (mm) | 0 | 0 | 0 | 0 | 0 | −7 | −5 |
| x1-x2 | | (mm) | 0 | 3 | 5 | 8 | 11 | 12 | 10 |
| Coordinate y1 | | (mm) | 3 | 4 | 4 | 4 | 5 | 5 | 4 |
| Coordinate y2 | | (mm) | 2 | 3 | 3 | 3 | 3 | 3 | 3 |
| y1-y2 | | (mm) | 1 | 1 | 1 | 1 | 2 | 2 | 1 |
| Hitting at toe 20 mm | Flight distance | (yard) | 203 | 208 | 206 | 203 | 196 | 209 | 208 |
| | Deviation in right and left direction | (yard) | 14 | 5 | 1 | 0 | 0 | 2 | 2 |
| Hitting at hit face center | Flight distance | (yard) | 212 | 211 | 210 | 210 | 208 | 209 | 210 |
| | Deviation in right and left direction | (yard) | 2 | 1 | −2 | −2 | −5 | 1 | −1 |
| Hitting at heel 20 mm | Flight distance | (yard) | 198 | 201 | 203 | 205 | 205 | 198 | 202 |
| | Deviation in right and left direction | (yard) | −10 | −6 | −3 | −1 | 3 | −4 | −2 |
| Evaluation on hitting | Capture of ball | | 2.2 | 3.8 | 4.3 | 4.4 | 4.4 | 4.2 | 4.1 |
| | Directionality of the ball | | 1.9 | 2.9 | 3.1 | 3.3 | 3.6 | 3.0 | 3.0 |

| | | | Comparative Example5 | Example3 | Example6 | Example7 | Example8 | Example9 |
|---|---|---|---|---|---|---|---|---|
| Distance D1 to the center of gravity | | (mm) | 39 | 38 | 37 | 38 | 40 | 41 |
| Coordinate x1 | | (mm) | 5 | 5 | 5 | 5 | 5 | 5 |
| Coordinate x2 | | (mm) | 2 | 5 | 0 | 0 | 0 | 0 |
| x1-x2 | | (mm) | 3 | 0 | 5 | 5 | 5 | 5 |
| Coordinate y1 | | (mm) | 4 | 3 | 3 | 3 | 5 | 6 |
| Coordinate y2 | | (mm) | 3 | 2 | 1 | 2 | 3 | 4 |
| y1-y2 | | (mm) | 1 | 1 | 2 | 1 | 2 | 2 |
| Hitting at toe 20 mm | Flight distance | (yard) | 205 | 195 | 204 | 205 | 206 | 205 |
| | Deviation in right and left direction | (yard) | 1 | 0 | 10 | 4 | −2 | −7 |
| Hitting at hit face center | Flight distance | (yard) | 210 | 208 | 209 | 209 | 210 | 211 |
| | Deviation in right and left direction | (yard) | −1 | −1 | −1 | −1 | −2 | −3 |
| Hitting at heel 20 mm | Flight distance | (yard) | 204 | 206 | 202 | 202 | 202 | 203 |
| | Deviation in right and left direction | (yard) | −2 | −2 | −7 | −5 | 2 | 7 |
| Evaluation on hitting | Capture of ball | | 4.4 | 4.4 | 4.1 | 4.1 | 4.3 | 4.3 |
| | Directionality of the ball | | 3.0 | 3.2 | 2.8 | 3.1 | 3.1 | 3.5 |

As shown in Table 1, Examples were more highly evaluated in comparison with Comparative Examples. Accordingly, advantages of the present invention are clearly indicated by these results of evaluation.

The present invention can be applied to all golf club heads such as wood golf club heads and iron club golf club heads.

The description hereinabove is merely for an illustrative example, and various modifications can be made in the scope not to depart from the principles of the present invention.

What is claimed is:

1. A golf club head comprising a face member having a hit face, a crown member, a sole member, a side member extending with the face member between the crown and sole members, and a hosel part, the hit face having a toe side and a heel side, wherein a horizontal direction oriented from the toe side toward the heel side is defined as an X direction, while a vertical upward direction is defined as a Y direction; coordinates of a center of the hit face are defined as (0, 0); coordinates of a sweet spot are defined as (x1, y1); and coordinates of a maximum resilience point on the hit face are defined as (x2, y2), such that x1 is +3 mm or greater and +8 mm or less, and x2 is −5 mm or greater and +2 mm or less, wherein the golf club head has a center of gravity that corresponds to the sweet spot such that a straight line extending from the center of gravity in a direction normal to the hit face intersects the sweet spot, and wherein the toe side and the heel side of the face member are integrally formed, and different thermal treatment specifications are employed for the toe side and heel side of the face member.

2. The golf club head according to claim 1, wherein a shortest distance D1 between an axis line of a shaft hole in the hosel part and a center of gravity G of the head is 33 mm or greater and 44 mm or less.

3. The golf club head according to claim 2, wherein the coordinate y2 of the maximum resilience point on the hit face is 1 mm or greater and 4 mm or less.

4. The golf club head according to claim 2, wherein the coordinate y2 of the maximum resilience point on the hit face is 1 mm or greater and 3 mm or less.

5. The golf club head according to claim 1 wherein, if the face member is divided into a toe portion and a heel portion by a plane that passes a center of the hit face along the Y direction, an area mean thickness Tt of the toe portion is smaller than an area mean thickness Th of the heel portion.

6. The golf club head according to claim 5, wherein the coordinate y2 of the maximum resilience point on the hit face is 1 mm or greater and 4 mm or less.

7. The golf club head according to claim 5, wherein the coordinate y2 of the maximum resilience point on the hit face is 1 mm or greater and 3 mm or less.

8. The golf club head according to claim 1, wherein a depth DG of a center of gravity is 36 mm or greater and 44 mm or less.

9. The golf club head according to claim 1, wherein the coordinate y2 of the maximum resilience point on the hit face is 1 mm or greater and 4 mm or less.

10. The golf club head according to claim 1, wherein the coordinate y2 of the maximum resilience point on the hit face is 1 mm or greater and 3 mm or less.

* * * * *